US012297595B2

(12) United States Patent
Wengierski et al.

(10) Patent No.: US 12,297,595 B2
(45) Date of Patent: May 13, 2025

(54) ENGINEERED CORN HUSK COMPOSITIONS AND METHODS

(71) Applicant: DW Specialized Products & Services, Inc., Dallas, TX (US)

(72) Inventors: David John Wengierski, Dallas, TX (US); Joseph Matthew Wengierski, Dallas, TX (US); Christopher David Wengierski, Dallas, TX (US)

(73) Assignee: Specialized Products & Services Co., Inc., Dallas, TX (US)

( * ) Notice: Subject to any disclaimer, the term of this patent is extended or adjusted under 35 U.S.C. 154(b) by 808 days.

(21) Appl. No.: 17/390,651

(22) Filed: Jul. 30, 2021

(65) Prior Publication Data

US 2022/0034028 A1 Feb. 3, 2022

Related U.S. Application Data

(60) Provisional application No. 63/058,973, filed on Jul. 30, 2020.

(51) Int. Cl.

| | |
|---|---|
| ***D21H 11/12*** | (2006.01) |
| ***D21B 1/02*** | (2006.01) |
| ***D21H 19/10*** | (2006.01) |
| ***D21H 23/56*** | (2006.01) |
| ***D21H 25/00*** | (2006.01) |
| ***D21H 25/02*** | (2006.01) |
| ***D21H 27/30*** | (2006.01) |

(52) U.S. Cl.

CPC ..... *D21B 1/021* (2013.01); *D21H 11/12* (2013.01); *D21H 19/10* (2013.01); *D21H 23/56* (2013.01); *D21H 25/005* (2013.01); *D21H 25/02* (2013.01); *D21H 27/30* (2013.01)

(58) Field of Classification Search

None

See application file for complete search history.

(56) References Cited

U.S. PATENT DOCUMENTS

| | | | |
|---|---|---|---|
| 5,194,461 | A | 3/1993 | Bergquist et al. |
| 5,688,448 | A | 11/1997 | Shutov et al. |
| 5,834,105 | A | 11/1998 | White et al. |
| 6,302,997 | B1 | 10/2001 | Hurter et al. |

(Continued)

FOREIGN PATENT DOCUMENTS

| | | | |
|---|---|---|---|
| CN | 107821785 | 3/2018 | |
| WO | WO-0146517 A1 * | 6/2001 | ..... C08B 30/10 |

OTHER PUBLICATIONS

Britannica, Formation of paper sheet by machines, Available at https://www.britannica.com/technology/papermaking/Formation-of-paper-sheet-by-machines, Accessed Oct. 1, 2021.

*Primary Examiner* — Jacob T Minskey

(74) *Attorney, Agent, or Firm* — C. Tumey Law Group PLLC

(57) ABSTRACT

A method is disclosed that includes washing corn husks with an acid wash to degrade at least a portion of a non-cellulosic material present in the corn husks and from pulped corn husks, wherein the non-cellulosic material comprises lignan. The method further comprises forming a slurry, wherein the slurry comprises pulped corn husks; forming the slurry into a sheet; removing a volume of liquid from the sheet; and calendaring the sheet. The method further comprises coating the sheet and cutting the sheet into a plurality of sheets.

20 Claims, 6 Drawing Sheets

(56) References Cited

U.S. PATENT DOCUMENTS

| | | | | |
|---|---|---|---|---|
| 9,809,702 | B2 | 11/2017 | Mohanty et al. | |
| 2003/0059601 | A1* | 3/2003 | Tokiyoshi | D21H 19/40<br>428/514 |
| 2003/0196771 | A1 | 10/2003 | Shaull | |
| 2004/0256065 | A1 | 12/2004 | Ahmed et al. | |
| 2018/0311675 | A1* | 11/2018 | Park | B02C 21/00 |
| 2019/0241744 | A1 | 8/2019 | Lange | |
| 2019/0309473 | A1 | 10/2019 | Sutterlin et al. | |

* cited by examiner

ENGINEERED CORN HUSK COMPOSITIONS AND METHODS

BACKGROUND

Corn husks are the outer covering of an ear of corn that have a variety of commercial uses. Commercially bought corn husks commonly include the whole husk and are sun, air, or oven dried. Corn husks are most commonly used to encase foods to be steamed or baked, such as a wrapping for tamales, a Mexican dish comprising cornmeal batter and shredded meat. Corn husks are also a favorite for wrapping fish and other types of seafood in preparation for grilling. Corn husks may also be used in other industries, including, but not limited to, paper, textiles, tobacco, home decor, and crafts.

In some of the largest agricultural industries, corn may be picked with a combine that separates the cob from the husks, stern, and leaves. During this process, the husk may be destroyed and returned to the soil. Conversely, in agricultural industries where corn is commonly hand-picked by laborers, the husks may be collected intact, whereby the intact corn husks have commercial value. However, this industry actively seeks alternative solutions to challenges arising from the increasing cost of corn husks due to labor shortages, weather conditions, alternative crop planting, and short supply.

DETAILED DESCRIPTION

Figure 3:
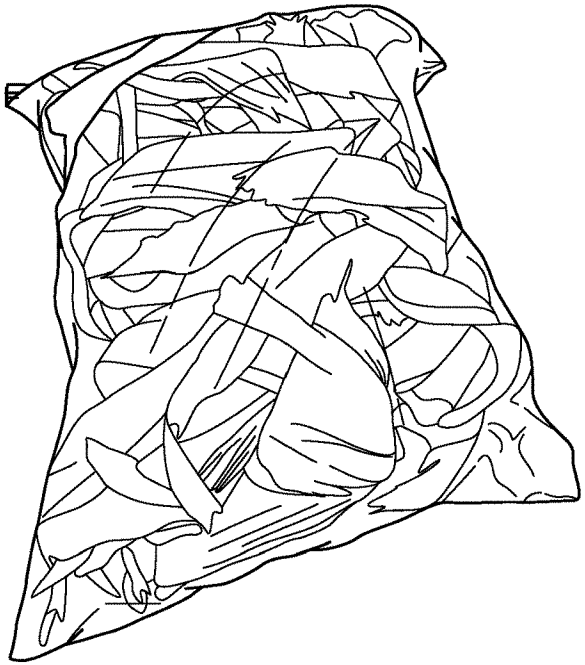
FIG. 3 is a perspective view of raw dried corn husk.
Figure 2:
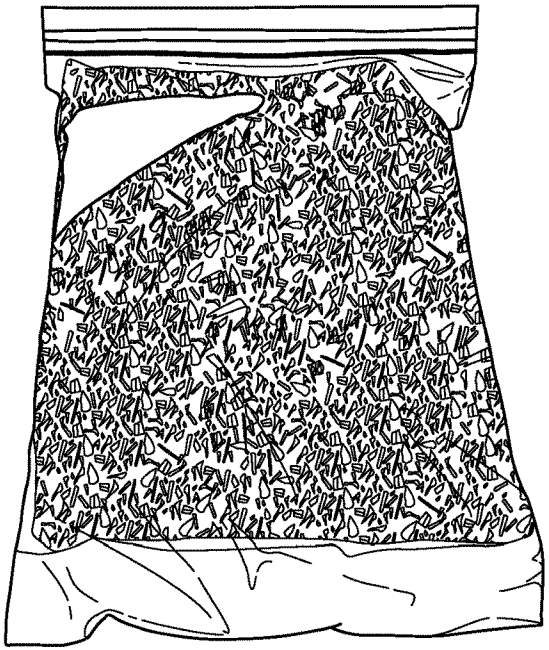
FIG. 2 is a perspective view of coarse ground corn husk.
Figure 1:
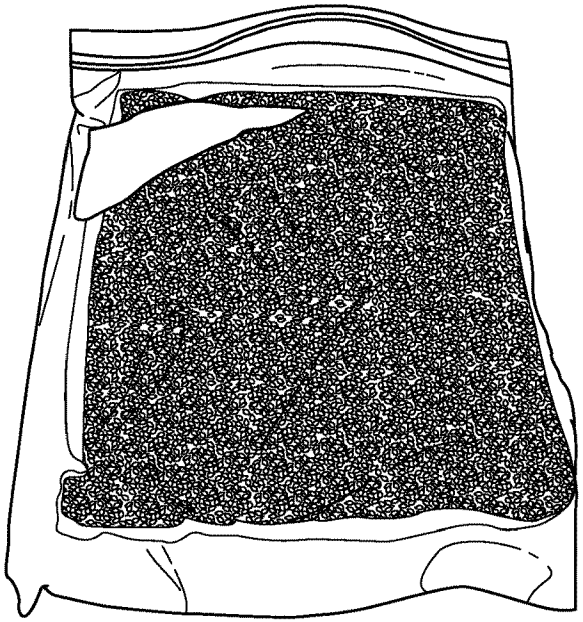
FIG. 1 is a perspective view of fine ground corn husk.
Figure 4:
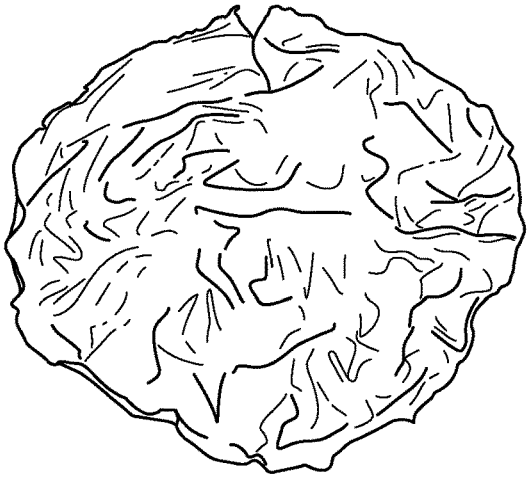
FIG. 4 is a perspective view of a dried composition without corn husk added.
Figure 5:
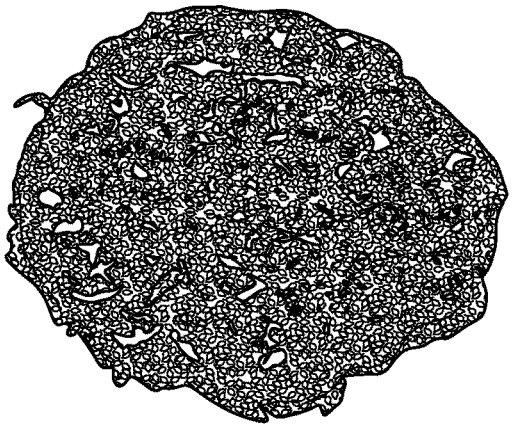
FIG. 5 is a perspective view of a dried corn husk composition comprising fine ground corn husks.
Figure 6:
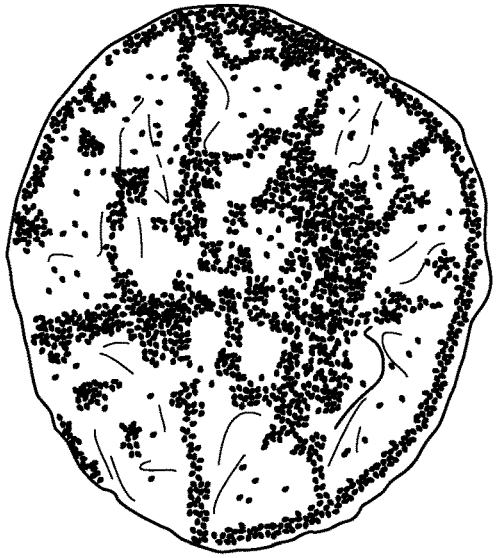
FIG. 6 is a perspective view of a dried corn husk composition comprising very finely ground corn husks.
Figure 7:
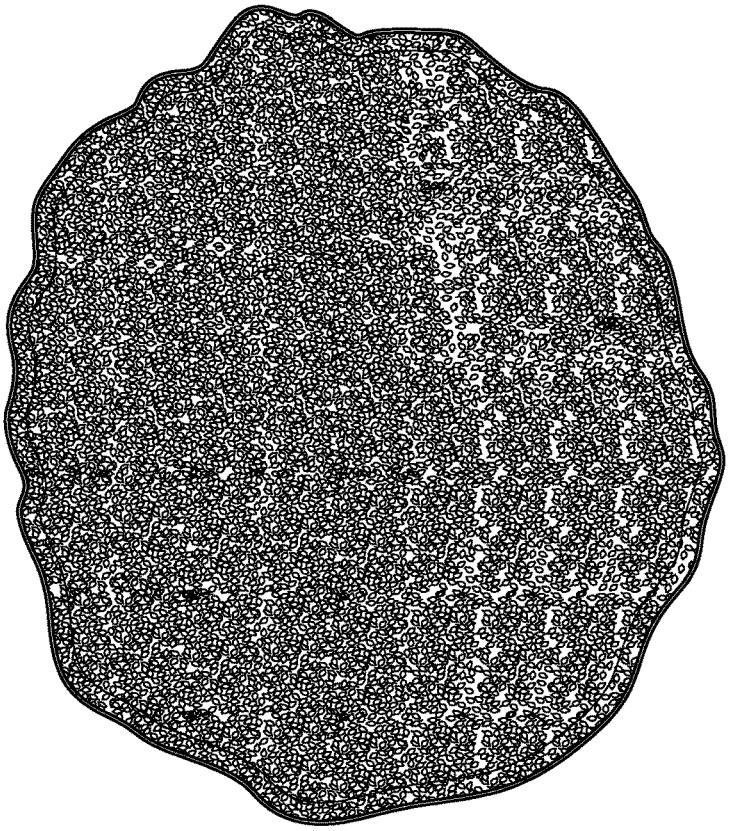
FIG. 7 is a perspective view of a dried corn husk composition comprising multiple layers of very finely ground corn husks and whole fiber corn husk strands.
Figure 8:
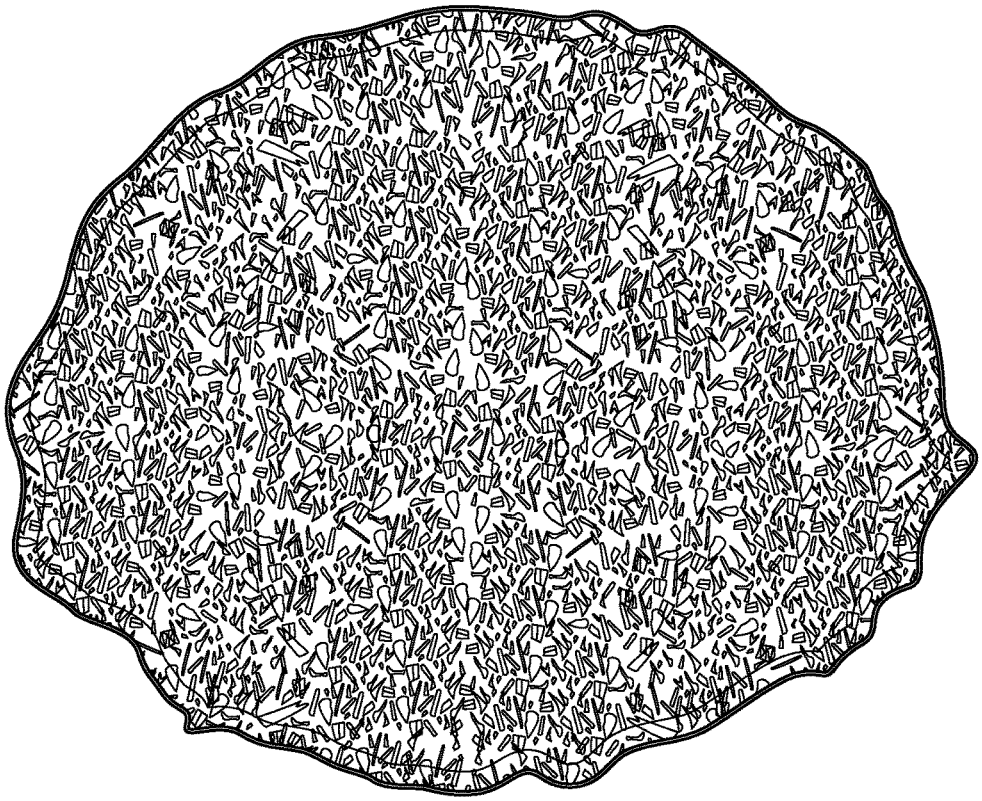
FIG. 8 is a perspective view of a dried corn husk composition comprising ground whole corn husks.

This disclosure is generally directed to compositions, methods, and systems for making engineered corn husks. Aspects of this disclosure are directed to the development and production of engineered corn husks comprising, but not limited to, agricultural corn byproducts, including corn husk portions, wherein the corn husk portions may include very finely ground corn husk, fine ground corn husk, coarse ground corn husk, or raw dried corn husk. Other aspects of this disclosure are directed to the development and production of engineered corn husks comprising, but not limited to, chemi-mechanical pulping of corn husks and corn stover, wherein the corn husks and corn stover may be collected from a field and transferred to a pulper. Any of a variety of process equipment may be utilized to develop a system of making the engineered corn husks described herein. The disclosed compositions, methods, and systems are also well suited to ensure consistency of engineered corn husk product quality, mass production of engineered corn husks, while maintaining the quality and characteristic of agriculturally farmed corn husks.

In some embodiments disclosed herein, engineered corn husks may be comprised of corn husk byproducts that may include, but may not be limited to, ground corn husks, dried corn husks, and/or corn stalk fragments. The corn husk byproducts may be processed or unprocessed, cleaned, or uncleaned, or treated or untreated. The ground corn husks may comprise very finely ground corn husk, fine ground corn husk, and/or coarse ground corn husk, which may be measured using coarse aggregate sieve analysis in the presence of a single-sized 35 mesh to 100 mesh sieves, 0.25 mm to 3 mm aggregate, and 5 mm to 15 mm aggregate, respectively.

The dried corn husk may include raw, dried corn husk, and may be cleaned or uncleaned, and treated or untreated. The engineered corn husk composition may further comprise crosslinkers and sealants. Crosslinkers may include, but may not be limited to sodium alginate, magnesium chloride, calcium bromide, calcium iodide, calcium fluoride, or combinations thereof. Sealants may include, but may not be limited to hydroxypropyl cellulose, carboxymethyl cellulose, methyl cellulose, hydroxypropyl methylcellulose, agar, or combinations thereof. al.

A method of making the engineered corn husks disclosed herein may include providing a corn husk byproducts mixture comprising ground corn husks, dried corn husks, corn stalk fragments, or combinations thereof. The corn husk byproducts mixture may further comprise crosslinkers and sealants. Crosslinkers may include, but may not be limited to sodium alginate, calcium chloride, magnesium chloride, calcium bromide, calcium iodide, calcium fluoride, or combinations thereof. Sealants may include, but may not be limited to, hydroxypropyl cellulose, carboxymethyl cellulose, methyl cellulose, hydroxypropyl methylcellulose, agar, or combinations thereof. The method may further comprise forming a first layer, wherein the first layer comprises the corn husk byproducts mixture. The method may further comprise heating the first layer of the corn husk byproducts mixture, for example, to about 45° C. to about 75° C., then drying the first layer of the corn husk byproducts mixture, for example, up to one (1) hour or longer. Alternatively, the corn husk byproducts mixture may be dried from about 1 minute to about 60 minutes, from about 5 minutes to about 55 minutes, from about 10 minutes to about 50 minutes, from about 15 minutes to about 45 minutes, from about 20 minutes to about 40 minutes, or from about 25 minutes to about 35 minutes.

The method may further comprise forming at least a second layer comprising the corn husk byproducts mixture, then dispensing the second layer of the corn husk byproducts mixture onto the first layer of the corn husk byproducts mixture to form a layered corn husk byproducts composition. The method may further comprise heating the layered corn husk byproducts composition, for example, to about 45° C. to about 75° C., then drying the layered corn husk byproducts composition, for example, up to one (1) hour or longer. Alternatively, the layered corn husk byproducts composition may be dried from about 1 minute to about 60 minutes, from about 5 minutes to about 55 minutes, from about 10 minutes to about 50 minutes, from about 15 minutes to about 45 minutes, from about 20 minutes to about 40 minutes, or from about 25 minutes to about 35 minutes.

The method may further comprise forming at least a third layer comprising the corn husk byproducts mixture, then dispensing the third layer onto the second layer to form the layered corn husk byproducts composition. The method may further comprise heating the layered corn husk byproducts composition, for example, from about 45° C. to about 75° C., then drying the layered corn husk composition, for example, up to one (1) hour or longer. Alternatively, the layered corn husk byproducts composition may be dried from about 1 minute to about 60 minutes, from about 5 minutes to about 55 minutes, from about 10 minutes to about 50 minutes, from about 15 minutes to about 45 minutes, from about 20 minutes to about 40 minutes, or from about 25 minutes to about 35 minutes.

The method may further comprise dispensing a final layer onto the at least second layer or any at least consecutive layer to form a final layered corn husk byproducts composition, wherein the final layer comprises a sealant. The sealant may comprise at least one polymeric sealant selected group consisting of sodium alginate, agar, hydroxypropyl cellulose, carboxymethyl cellulose, methyl cellulose, hydroxypropyl methylcellulose, and combinations thereof. The method may further comprise heating the final layered corn husk composition, for example, to about 45° C. to about 75° C., then drying the final layered corn husk byproducts composition, for example, up to one (1) hour or longer. Alternatively, the final layered corn husk byproducts composition may be dried from about 1 minute to about 60 minutes, from about 5 minutes to about 55 minutes, from about 10 minutes to about 50 minutes, from about 15 minutes to about 45 minutes, from about 20 minutes to about 40 minutes, or from about 25 minutes to about 35 minutes.

The method may further comprise treating the final layered corn husk byproducts composition with a crosslinker, wherein the crosslinker may act as a stabilizer. The crosslinker include salts that provide ions for crosslinking, including, but not limited to, calcium chloride, magnesium chloride, calcium bromide, calcium iodide, calcium fluoride, and combinations thereof. The crosslinker may be present in any suitable amount, for example, about 0.5 wt % to about 10 wt % by volume of the total composition. Alternatively, the crosslinker may be present in an amount of about 0.5 wt % to about 10 wt %, about 1 wt % to about 8 wt %, about 2 wt % to about 6 wt %, or about 3 wt % to about 5 wt % by volume of the total composition. The engineered corn husk byproducts composition may be formed after treating the final layered corn husk composition with the In other embodiments disclosed herein, a method of making the engineered corn husks may include providing whole corn husks and/or corn stover, wherein the whole corn husks and/or corn stover may be collected directly from a farming field. The corn stover may comprise a mixture comprising portions of corn stalks, corn leaves, corn husks, and/or corn tassels left in the field after harvesting grain with a combine. The method may comprise transferring the corn husks, corn stover, or a combination thereof, to a chemi-mechanical pulping process, which includes cleaning the corn husks and/or corn stover. The chemi-mechanical pulping process may comprise separating fibrous materials, such as the corn husks, corn stover, or combination thereof, by utilizing chemical, heat, and mechanical means. More specifically, the chemi-mechanical pulping process may involve both a crushing action of mechanical pulping, as well as the addition of an alkali acid to break down lignin, wherein the lignin naturally holds the fibers in the corn husks and corn stover together. After cleaning the corn husks and corn stover, the method may further comprise pulping the corn husks and corn stover, wherein the pulping results in forming a slurry. Hence, the pulping process comprises mechanically extruding the non-cellulosic material and chemically impregnating the slurry. The method may further comprise forming the slurry into a sheet; removing any excess liquid from the sheet, wherein the excess liquid may comprise water, process fluids, and combinations thereof; and calendaring the sheet. The method may further comprise cutting the sheet, wherein the sheet may be cut into a uniform size or a plurality of sizes; sorting the cut sheets into bundles according to size; and recycling any excess portions of the sheet, wherein the recycled portions of the sheet may be returned to the pulping and/or slurry portion of the process disclosed herein. The method may further comprise coating the sheet, wherein the coating may occur before cutting the sheet or after cutting the sheet, wherein the sorted bundles may be coated. In some examples, the coating may be a single coating process; whereas, in other examples, the coating may comprise two or more coating processes. The coating may comprise a heat-resistant composition, a non-stick or silicone-type composition, or combination thereof.

The method disclosed herein may comprise applying an alkali acid wash to degrade and/or solubilize at least a portion of a non-cellulosic material, such as lignin, naturally occurring and present in the corn husks and corn stover. The alkali may be present in the process in an any suitable amount, for example, about 5% by weight to about 40% by weight on oven dried fiber (ODF). Alternatively, the alkali may be present in the process in an amount of about 5% to about 40%, about 10% to about 35%, about 15% to about 30%, or about 20% to about 25% by weight on ODF. The alkali may include a variety of alkali, such as sodium hydroxide, potassium hydroxide, calcium hydroxide, ammonium hydroxide, or any combination thereof.

The temperature of the alkali acid wash may range, for example, from ambient temperature to about 160° C. Alternatively, the temperature may range from about 20° C. to about 160° C., about 30° C. to about 150° C., about 40° C. to about 140° C., about 50° C. to about 130° C., about 60° C. to about 120° C., about 70° C. to about 110° C., or about 80° C. to about 100° C. The pressure during the alkali acid wash may be any suitable pressure, for example, ranging from about atmospheric pressure to about 30 psig. Alternatively, the pressure may range from about 14.7 psig to about 27 psig, about 16 psig to about 25 psig, or about 18 psig to about 23 psig.

The method may include an additional wash step, wherein a suitable acid solution may react with residual lignan and remove any metal ions present in the slurry. The slurry may be acidified to an acidic pH to cause the metal ions to be released from the slurry. Optionally, a chelating agent may be applied to tie up the metal ions and render them unable to affect subsequent stages, including subsequent, optional, bleaching stages. After the alkali wash, slurry may be treated with an acid solution to an acidic pH. The acid solution at this step may include, but may not be limited to, sulfuric acid, nitric acid, phosphoric acid, or acetic acid. The pH stage may range, for example, from about 0 to about 6. Alternatively, the pH stage may range from about 0 to about 6, about 1 to about 5, or about 2 to about 4. The temperature may range, for example, from about 20° C. to about 100° C. Alternatively, the temperature may range from about 25° C.

to about 95° C., about 30° C., to about 90° C., about 35° C. to about 85° C., about 40° C. to about 80° C., or about 45° C. to about 75° C.

The method may also include an optional bleaching step. For example, an alkaline hydrogen peroxide bleaching solution or a chlorine-based bleaching solution may contact the slurry to remove substantially all of the non-cellulosic, or lignin, material remaining in the slurry, for example, 99% or more by volume of the slurry. The bleaching solution may also comprise peroxide stabilizers, such as chelants, including, but not limited to, sodium silicate and magnesium sulfate, incorporated therein.

After the washing and optional bleaching steps, the slurry may be formed into a sheet. It should be noted that the basis weight and the width of the sheet may vary. Consequently, the slurry may be formed into a sheet of desired weight by filtration, pressing and consolidating the slurry composition, which further comprises removing excess liquids by drying any remaining liquids by evaporation, then subsequently winding the sheet into reels of a formed, paper-like composition. The filtration, pressing, and consolidating of the sheet may be accomplished by a plurality of methods, including, but not limited to, traveling the sheet on at least one horizontal wire-screen belt; sandwiching the sheet between two horizontal wide-screen belts; forming the sheet on a suction cylinder roll or combinations thereof. More specifically, the method disclosed herein may further comprise draining water and other liquids from the sheet, pressing the wet sheet for additional removal of water of other liquids, partially drying the sheet, carrying the partially dried sheet through a series of rotating, steam-heated cylinders to remove any remaining moisture; and compressing and smoothing the sheet with a calendar stack (calendaring the sheet).

The method may further comprise coating the sheet. Coating the sheet may comprise running the sheet through a bath of sulfuric acid, zinc chloride, or any other suitable acid. Running the sheet through the acid bath may dissolve or gelatinize the sheet. A sulfurized cross-linked material may be formed as a result of this treatment. The properties of the resulting sulfurized, cross-linked sheet material may include, but may not be limited to, high density, stability, heat resistance, grease resistance, water resistance, low surface energy, and minimal loose fibers, thereby imparting excellent non-stick or release properties. It should be noted that this coating process may be a singular coating process, a dual coating step, or a multi-coating process. More specifically, the number of coatings and the type of coatings may vary, depending upon the desired properties of the sheet. For example, the coating may comprise a singular heat resistant composition, a singular non-stick or silicone-type composition, a singular grease resistance composition, a singular water resistance composition, or any combination thereof, wherein the combination thereof may result in a single bath coating process, or a plurality of multiple bath processes. The method may also comprise winding the sheet into a roll. The method may further comprise cutting or punching the sheet into either uniform sizes or a plurality of sizes; sorting the sheets based on size; then recycling any excess portions of the sheet back to the pulping or slurry portion of the process.

A method may comprise providing a corn husk byproducts mixture comprising ground corn husks, dried corn husks, corn stalk fragments, or combinations thereof. The method may further comprise forming a first layer, wherein the first layer comprises the corn-husk byproduct mixture. The method may further comprise heating the first layer of the corn husk byproducts mixture. The method may further comprise heating the first layer of the corn husk byproducts mixture, then drying the first layer. The method may further comprise forming at least a second layer comprising the corn husk byproduct mixture, then dispensing the second layer of the mixture onto the first layer of the mixture to form a layered corn husk byproducts composition. The method may further comprise heating the layered corn husk byproducts composition. The method may further comprise forming at least a third layer comprising the corn husk byproducts mixture, then dispensing the third layer onto the second layer to form the layered corn husk byproducts composition. The method may further comprise additional heating of the composition. The method may comprise dispensing a final layer onto the at least second layer or any at least consecutive layer to form a final layered corn husk byproducts composition, wherein the final layer comprises a sealant, wherein the sealant may be a food grade sealant. The method may comprise heating the composition after the addition of the sealant. The method may further comprise treating the final layered corn husk composition with a crosslinker, wherein the crosslinker may be a stabilizer, and wherein the crosslinker may be a food grade crosslinker. The method may further comprise layering the corn husk byproducts composition onto a mold.

Another method may comprise providing corn husks and corn stover, then transferring the corn husks, corn stover, or combination thereof, to a chemi-mechanical pulping process. The method may further comprise applying an alkali acid wash to degrade and/or solubilize at least a portion of lignan, wherein the lignan is present in the corn husks and corn stover. The method may further comprise pulping the corn husks and corn stover and forming a slurry. The method may further comprise an additional wash step, wherein a suitable acid solution may react with any residual lignan and remove any metal ions present in the slurry. The method may comprise an optional bleaching step. The method may further comprise forming the slurry into a sheet; removing any excess liquid from the sheet and calendaring the sheet. The method may further comprise cutting the sheet, sorting the cut sheets into bundles; and recycling any excess portions of the sheet, wherein the recycled portions of the sheet may be returned to the pulping and/or slurry portion of the process disclosed herein. The method may further comprise coating the sheet, wherein the coating may occur before cutting the sheet or after cutting the sheet, and wherein the coating may comprise a food grade silicon coating.

A composition may comprise corn husks, dried corn husks, corn stalk fragments, or combinations thereof; a sealant, wherein the sealant may be a food grade sealant; and a crosslinker, wherein the crosslinker may be a stabilizer, and wherein the crosslinker may be a food grade crosslinker. Another composition may comprise corn husks, corn stover, or combination thereof; and a coating, wherein the coating may comprise a food grade silicon coating.

A system may comprise corn husks, corn stover, or combination thereof; a conveyor; a washer; a cutter or puncher; a separator; a dryer; a calendaring roll; and a stacker or bundler.

Figure 9:
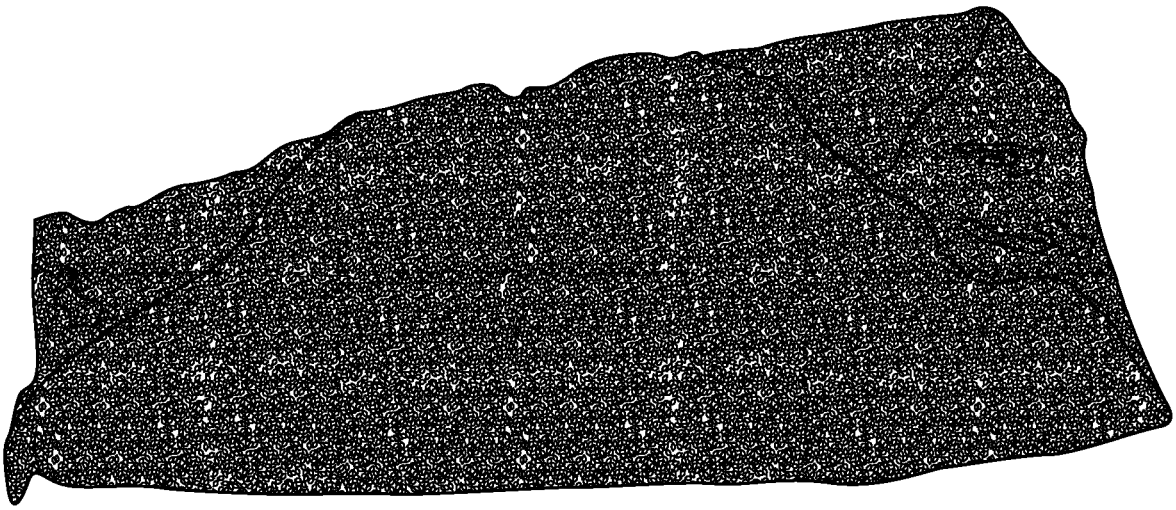
FIG. 9 is a perspective view of an engineered corn husk folded in half.
Figure 10:
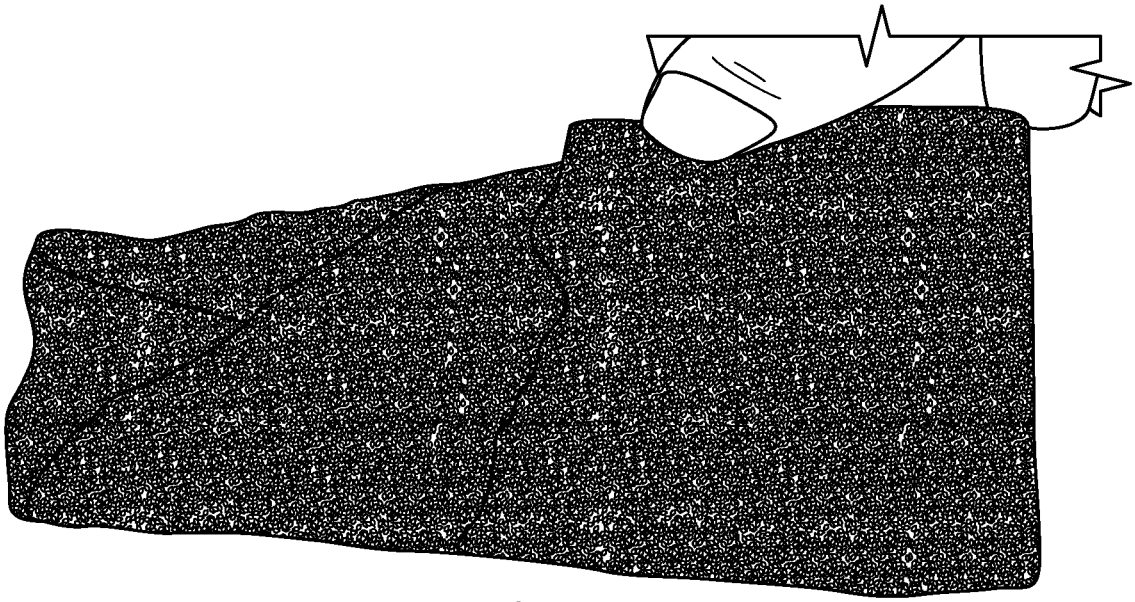
FIG. 10 is a perspective view of an engineered corn husk folded tamale style.
Figure 11:
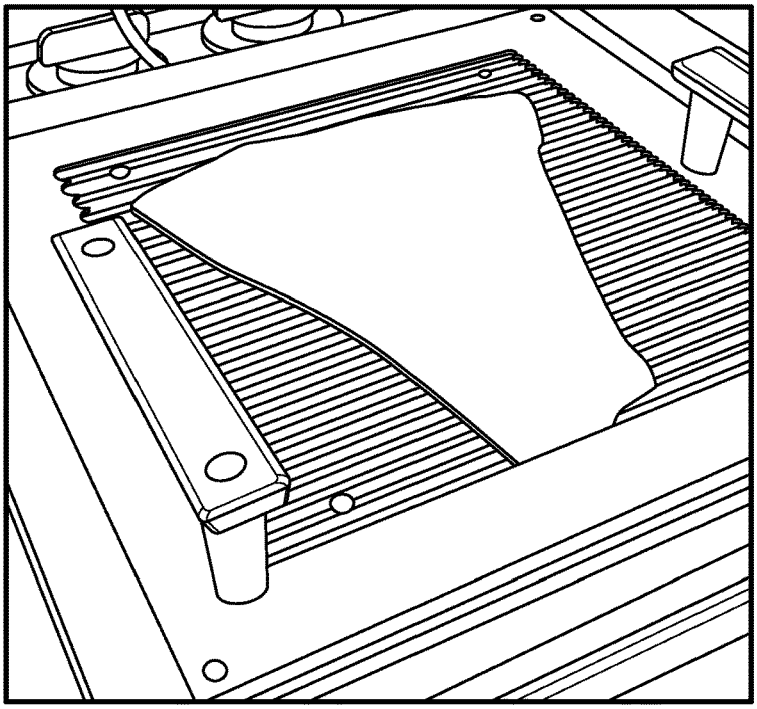
FIG. 11 is a perspective view of a corn husk composition applied to a mold.

FIGS. 1-8 present perspective views of various types of dried corn husks, wherein the corn husk starting material for methods disclosed herein may include, but may not be limited to, fine ground corn husk, coarse ground corn husk, raw dried corn husk, dried composition without corn husk added, dried corn husk composition comprising fine ground corn husks, corn husk composition comprising very finely ground corn husks, dried corn husk composition comprising layers of very finely ground corn husks and whole fiber corn husk strands, and dried corn husk composition comprising ground corn husks. FIGSs. 9 and 10 present perspective views of engineered corn husk compositions, wherein FIG. 9 presents an engineered corn husk composition folded in half, and wherein FIG. 10 presents an engineered corn husk folded tamale style. FIG. 11 presents a perspective view of a corn husk composition applied to a mold. The mold may be designed to include various grooves or striations that form a pattern resembling the aesthetic and texture of natural, agriculturally farmed corn husks.

Figure 12:
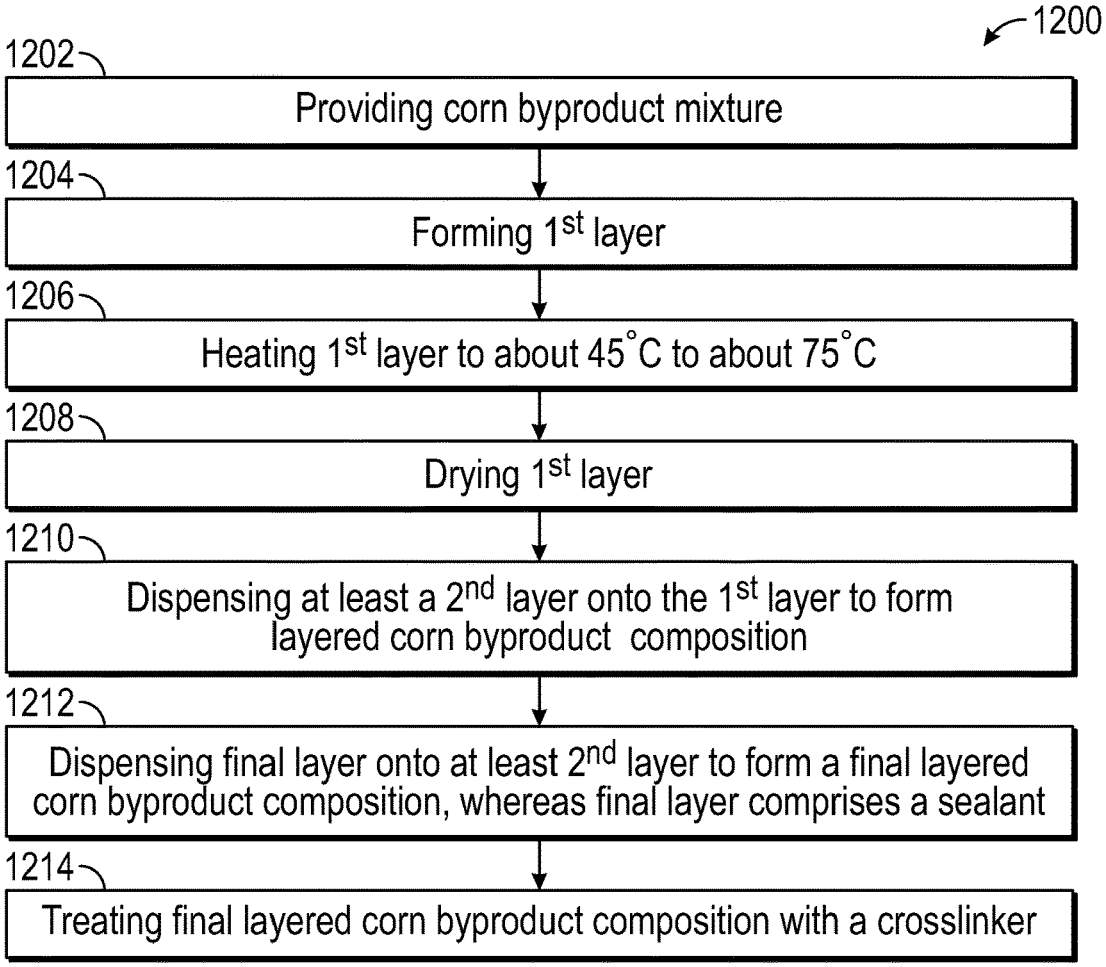
FIG. 12 is a flow diagram depicting a method of making engineered corn husk compositions.

FIG. 12 is a flow diagram depicting a method 1200 of making engineered corn husk compositions. Method 1200 comprises providing a corn byproduct mixture 1202, then forming a first layer 1204. After forming, the first layer is heated to a temperature, for example, of about 45° C. to about 75° C. at step 1206. The next step is drying the first layer 1208, then dispensing at least a second layer onto the first layer to form a layered corn byproduct composition 1210. The next step comprises dispensing a final layer onto at least a second layer to form a final layered corn byproduct composition, wherein the final layer comprises a sealant 1212. Method 1200 then provides for treating the final layered corn byproduct composition with a crosslinker 1214.

Figure 13:
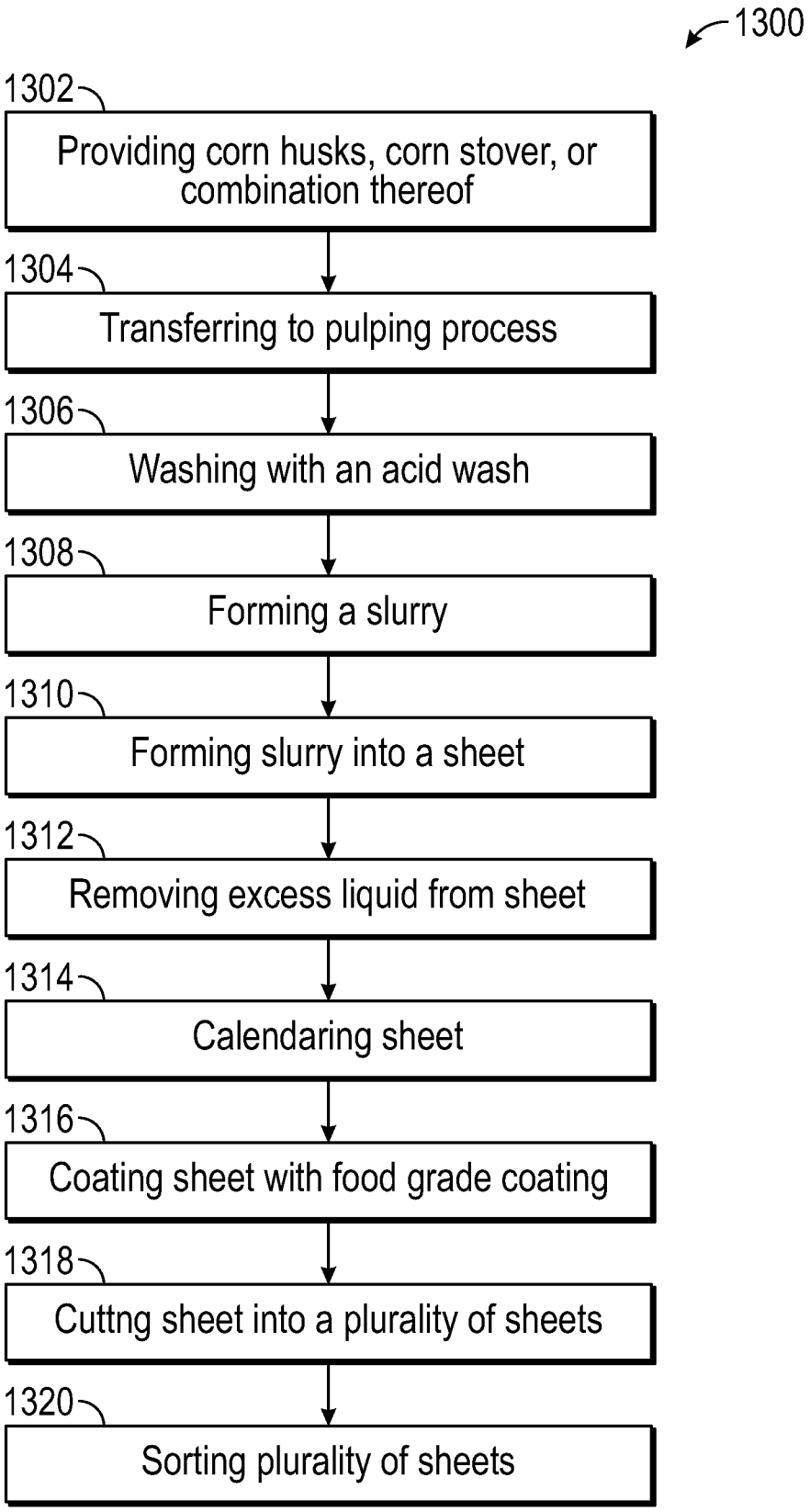
FIG. 13 is a flow diagram depicting another method of making engineered corn husk compositions.

FIG. 13 is a flow diagram depicting another method 1300 of making engineered corn husk compositions. Method 1300 comprises providing corn husks, corn stover, or a combination thereof 1302. The corn husks, corn stover, or combination thereof are then transferred to a pulping process 1304, which comprises washing with an acid wash 1306. After washing step 1306, method 1300 comprises forming a slurry 1308, then forming the slurry into a sheet 1310. Excess liquid is removed from the sheet 1312, then calendaring is performed on the sheet 1314. Method 1300 then comprises coating the sheet with a food grade coating 1316; cutting the sheet into a plurality of sheets 1318; then sorting the plurality of sheets 1320.

The methods and compositions may include any of the various features disclosed herein, including one or more of the following statements:

Statement 1. A method may comprise washing corn husks with an acid wash to degrade at least a portion of a non-cellulosic material present in the corn husks and form pulped corn husks, wherein the non-cellulosic material comprises lignan; forming a slurry, wherein the slurry comprises pulped corn husks; forming the slurry into a sheet; removing a volume of liquid from the sheet; calendaring the sheet; coating the sheet; and cutting the sheet into a plurality of sheets.

Statement 2. The method statement 1, further comprising recycling a portion of the sheet, wherein the recycled portion of the sheet is returned to either the washing step or the forming the slurry step.

Statement 3. The method of statement 1 or 2, further comprising an additional wash step that comprises contacting the slurry with an acid solution, wherein the acid solution reacts with any residual lignan in the pulped corn husks and removes any metal ions present in the slurry.

Statement 4. The method of any of the preceding statements, wherein the washing comprising washing a mixture of the corn husks and corn stover.

Statement 5. The method of any of the preceding statements, wherein the pulping process mechanically extruding the non-cellulosic material and chemically impregnating the slurry.

Statement 6. The method of any of the preceding statements, wherein the temperature of the acid wash is from about 20° C. to about 160° C.

Statement 7. The method of any of the preceding statements, wherein the acid wash is an alkali wash, wherein an alkali is present in the alkali wash in an amount of about 5% to about 40% by volume of the wash.

Statement 8. The method of any of the preceding statements, wherein the alkali is selected from the group consisting of sodium hydroxide, potassium hydroxide, calcium hydroxide, ammonium hydroxide, and combinations thereof.

Statement 9. The method of any of the preceding statements, further comprising treating the slurry with an acid solution to an acidic pH after the washing step.

Statement 10. The method of statement 9, wherein the acid solution comprises sulfuric acid, nitric acid, phosphoric acid, or acetic acid.

Statement 11. The method of statement 9 or 10, wherein the pH is from about 0 to about 6, and wherein the temperature is from about 20° C. to about 100° C.

Statement 12. The method of any of the preceding statements, further comprising an optional bleaching step after the wash step.

Statement 13. The method of statement 12, wherein the bleaching step comprises an alkaline hydrogen peroxide bleaching solution.

Statement 14. The method of statement 12 or 13, wherein the bleaching step comprises a chlorine-based bleaching solution.

Statement 15. The method of any of the preceding statements, wherein the coating comprises running the sheet through an acid bath to form a cross-linked material.

Statement 16. The method of any of the preceding statements, wherein the coating comprises a singular coating process, a dual coating process, or a multi-coating process.

Statement 17. The method of any of the preceding statements, wherein the coating comprises a heat-resistant composition, a grease resistant composition, a non-stick composition, or a combination thereof.

Statement 18. The method of statement 17, wherein the non-stick composition comprises a food grade silicon composition.

Statement 19. A method may comprise forming a first layer, wherein the first layer comprises a corn byproduct mixture; heating the first layer of the corn byproduct mixture; drying the first layer of the corn byproduct mixture; dispensing at least a second layer of the corn byproduct mixture onto the first layer of the corn byproduct mixture to form a layered corn byproduct composition; dispensing a final layer onto the at least second layer of the corn byproduct mixture to form a final layered corn byproduct composition, wherein the final layer comprises a sealant; and treating the final layered corn byproduct composition with a crosslinker.

Statement 20. A composition may comprise a corn byproduct; a sealant; and a crosslinker.

It should be understood that the compositions and methods are described in terms of "comprising," "containing," or "including" various components or steps, the compositions and methods can also "consist essentially of" or "consist of" the various components and steps. Moreover, the indefinite articles "a" or "an," as used in the claims, are defined herein to mean one or more than one of the elements that it introduces.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Although individual embodiments are discussed, the invention covers all combinations of all those embodiments. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of the present invention. If there is any conflict in the usages of a word or term in this specification and one or more patent(s) or other documents that may be incorporated herein by reference, the definitions that are consistent with this specification should be adopted.

What is claimed is:

1. A method comprising:
collecting corn stover;
transferring the collected corn stove pulper:
pulping the transferred corn stover to form a slurry:
extruding at least in part non-cellulosic material from the slurry:
forming sheet from the slurry removing any excess liquid from the sheet; and
cutting the sheet into engineered corn husks.

2. The method of claim 1, further comprising recycling a portion of the sheet wherein the recycled portion of the sheet is returned to the forming the slurry.

3. The method of claim 1, further comprising a wash step that comprises contacting the slurry with an acid solution, wherein the acid solution reacts with any residual lignan in the pulped corn husks and removes any metal ions present in the slurry.

4. The method of claim 3, wherein the wash step comprises washing a mixture of the corn stover.

5. The method of claim 1, wherein the pulping comprises mechanically extruding the non-cellulosic material and chemically impregnating the slurry.

6. The method of claim 3, wherein the temperature of the wash step is from about 20° C. to about 160° C.

7. The method of claim 3, wherein the wash step is an alkali wash, wherein an alkali is present in the alkali wash in an amount of about 5% to about 40% by volume of the wash.

8. The method of claim 7, wherein the alkali is selected from the group consisting of sodium hydroxide, potassium hydroxide, calcium hydroxide, ammonium hydroxide, and combinations thereof.

9. The method of claim 3, further comprising treating the slurry with an acid solution to an acidic pH after the wash step.

10. The method of claim 9, wherein the acid solution comprises sulfuric acid, nitric acid, phosphoric acid, or acetic acid.

11. The method of claim 9, wherein the acidic pH is from about 0 to about 6, and wherein the temperature of the acid solution is from about 20° C. to about 100° C.

12. The method of claim 3, further comprising an optional bleaching step after the wash step.

13. The method of claim 12, wherein the bleaching step comprises an alkaline hydrogen peroxide bleaching solution.

14. The method of claim 12, wherein the bleaching step comprises a chlorine-based bleaching solution.

15. The method of claim 1, further comprising a coating step comprising running the sheet through an acid bath to form a cross-linked material.

16. The method of claim 15, wherein the coating step comprises a singular coating process, a dual coating process, or a multi-coating process.

17. The method of claim 15, wherein the coating step comprises a heat-resistant composition, a grease resistant composition, a non-stick composition, or a combination thereof.

18. The method of claim 17, wherein the non-stick composition comprises a food grade silicon composition.

19. A method comprising:
collecting corn stover;
transferring the collected corn stover to a pulper;
pulping the transferred corn stover to form a slurry;
extruding at least in part non-cellulosic material from the slurry;
forming sheet from the slurry removing any excess liquid from the sheet; and
cutting the sheet into engineered corn husks comprising grooves or striations that form a pattern resembling an aesthetic and a texture of natural, agriculturally farmed corn husks.

20. The method of claim 1, further comprising coating the sheet with a non-stick composition.

* * * * *